US005675992A

United States Patent [19]

Wrightenberry

[11] Patent Number: 5,675,992

[45] Date of Patent: Oct. 14, 1997

[54] DOUBLE LAYER SOCK WITH ATTACHED LINER AND METHOD FOR FORMING SAME

[76] Inventor: Jerry O. Wrightenberry, 3110 Forestdale Dr., Burlington, N.C. 27215

[21] Appl. No.: 709,618

[22] Filed: Sep. 9, 1996

[51] Int. Cl.[6] ..... D04B 11/00; D04B 9/46; A41B 11/02

[52] U.S. Cl. ..... 66/178 R; 66/171; 66/188; 2/239

[58] Field of Search ..... 66/185, 178 R, 66/171, 188, 182; 2/239, 240

[56] References Cited

U.S. PATENT DOCUMENTS

| | | | |
|---|---|---|---|
| 2,263,763 | 11/1941 | Edwards | 66/178 |
| 3,307,379 | 3/1967 | Woolley et al. | 66/178 |
| 3,796,067 | 3/1974 | East | 66/178 |
| 4,341,096 | 7/1982 | Safrit et al. | 66/185 |
| 4,373,215 | 2/1983 | Guigley | 2/239 |
| 4,373,361 | 2/1983 | Thorneburg | 66/178 |
| 4,467,626 | 8/1984 | Coble et al. | 66/196 |
| 5,226,194 | 7/1993 | Staley | 2/239 |

FOREIGN PATENT DOCUMENTS

| | | | |
|---|---|---|---|
| 722958 | 3/1932 | France | 66/178 X |
| 2454766 | 4/1980 | France . | |

*Primary Examiner*—John J. Calvert

[57] ABSTRACT

A double layer sock that has a tubular inner ply having a foot portion and a leg portion merging substantially at the ankle of a wearer. A tubular outer ply surrounds the inner ply and has a foot and a leg portion merging substantially at the ankle of the wearer and aligned with the foot and leg portions of the inner ply. The plies are joined adjacent a top opening in the leg portion and arranged to receive a wearer's foot. A seam joins the plies and is located substantially adjacent the merging of the foot and leg portions to maintain proper alignment of the foot portions of the two plies. Methods of making a two ply sock are also disclosed. Preferably, the seam connecting the plies is knit such that the plies maintain proper alignment with one another.

17 Claims, 2 Drawing Sheets

DOUBLE LAYER SOCK WITH ATTACHED LINER AND METHOD FOR FORMING SAME

FIELD OF THE INVENTION

The present invention is directed to a double ply sock and method for forming the same, and more particularly, to a double ply sock having the inner and outer plies thereof joined by a selectively located seam to ensure proper alignment of the plies.

BACKGROUND OF THE INVENTION

Double layer socks are useful in many applications when a single layer sock is not adequate. A double ply sock provides additional cushioning of the foot and calf which is especially advantageous when engaged in strenuous activities such as running, hiking, playing basketball, and others. The additional cushioning allows the sock to absorb additional impact, reducing the impact upon the wearer. Additionally, the extra ply provides for a more comfortable fit as the rough, hard edges of shoes or boots are isolated from the wearer's foot providing for a reduction in blisters, abrasions, and other skin irritations. A double layer sock is also advantageous in environments requiring additional warmth as the second layer provides an added layer of insulation. Double layer socks provide for movement between the plies thereby reducing the movement between the inner ply and the wearer's foot, resulting in a more comfortable fit. With the many advantages, there are limitations and drawbacks encountered with presently available double layer socks.

A common problem experienced with double layer socks is that the inner layer has a tendency to wrinkle inside the outer layer. As the sock is worn, the inner layer slides relative to the outer layer resulting in bunching at the toes. U.S. Pat. No. 4,467,626, issued to Coble et al., discloses a double layer sock with the plies connected together at one or more locations rearwardly of the toe. This design often results in an uncomfortable fit as the seams located in the foot portion rub against the wearer's skin. This design also prohibits the inner ply from moving freely from the outer ply. Free movement between the plies is desirable to reduce sliding between the inner layer and the wearer's foot, a primary advantage of double ply socks.

Thus, there exists a need for a double layer sock in which the inner layer does not wrinkle or bunch while worn and which ensures alignment of the inner and outer layers. Further, there exists a need for a double layer sock that ensures alignment of the layers but does not unduly restrict relative movement between the inner and outer layers, thereby minimizing movement between the inner layer and foot and providing for a more comfortable fit.

SUMMARY OF THE INVENTION

The present invention is generally directed to a double ply sock which overcomes the various deficiencies noted above, and a method for forming the same. In each embodiment, the double ply sock is provided with a selectively located seam to ensure proper relative alignment of the plies. Preferably, the sock is particularly constructed and provided with certain features and materials as discussed below.

The present invention is directed to a double ply sock. The sock includes a tubular inner ply having a foot portion and a leg portion merging substantially at the ankle of a wearer. A tubular outer ply surrounds the inner ply having a foot portion and a leg portion merging substantially at the ankle of the wearer and aligning with the foot portion and the leg portion, respectively, of the inner ply. The inner ply and the outer ply define a top opening in the leg portion and is arranged and configured to receive a wearer's foot. The inner and outer plies being joined adjacent the top opening. A seam joining the inner ply and the outer ply is located substantially adjacent the merging of the foot portions and leg portions for the purpose of maintaining proper alignment of the foot portions of the two plies and having the plies each extend above and below the seam.

Preferably, the sock is formed such that the inner and outer plies extend the entire length of the sock. Alternatively, the foot portions of the inner and outer plies may extend to a respective toe end. A single ply band may be attached to each of the leg portions of the inner and outer plies at the upper end and extend upwardly therefrom. The sock may be constructed such that each foot portion of the inner and outer plies have respective toe end openings that are closed by a common seam. Alternatively, each foot portion of the inner and outer plies may have respective toe end openings that are closed by a respective end seam. The sock may contain a respective heel pocket in each of the inner and outer plies such that the heel pockets are disposed proximate a wearer's heel when the sock is worn. The heel pocket of each of the foot portions of the inner and outer plies has a respective toe end and are disposed between the connecting seam and the respective toe ends. Preferably, the connecting seam connects the inner ply to the outer ply by a continuous stitch row extending around the circumference of the sock. The plies may be constructed from a unitary knitting operation having the plies connected by a fold line at the top opening. Preferably, the seam is knit into each of the inner and outer plies.

The present invention is further directed to a method of making a two ply sock of unitary tubular construction. A first foot portion is knit. A first leg is knit that is attached to the first foot portion and a second leg portion is knit that is attached to the first leg portion. A common seam is knit joining the first foot portion, the first leg portion and the second leg portion. Next, a second foot portion is knit such that it is attached to the common seam. The first and second foot portions are closed. Preferably, the step of knitting the seam includes knitting the seam such that it extends about the circumference of the sock.

The present invention is further directed to a method as follows for making a two ply sock having an inner ply and an outer ply. A singular tubular garment having opposed open ends is knit having a first continuous section corresponding to the inner ply and a second continuous section corresponding to the outer ply. A fold is then formed between the first and second sections. The open ends of the garment are closed. The first and second sections are joined together by a connecting seam at a location in the garment above a wearer's ankle when the sock is worn.

In the method described immediately above, preferably the step of joining the first and second sections includes inserting the connecting seam such that it extends about the circumference of the sock. The step of joining the first and second sections preferably includes knitting the connecting seam into each of the first and second sections. Alternatively, the step of joining the first and second sections includes sewing the connecting seam into each of the first and second sections.

A primary objective of the present invention is to provide an improved double ply sock.

It is an object to provide a double ply sock in which the plies are connected by a seam that ensures alignment of the inner and outer plies.

An object of the present invention is to provide a double ply sock in which the inner and outer plies can move freely of each other.

Yet another object is to provide a double ply sock as described above which reduces sliding movement between the inner ply and the wearer's foot.

The preceding and further objects of the present invention will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENT

Figure 2:
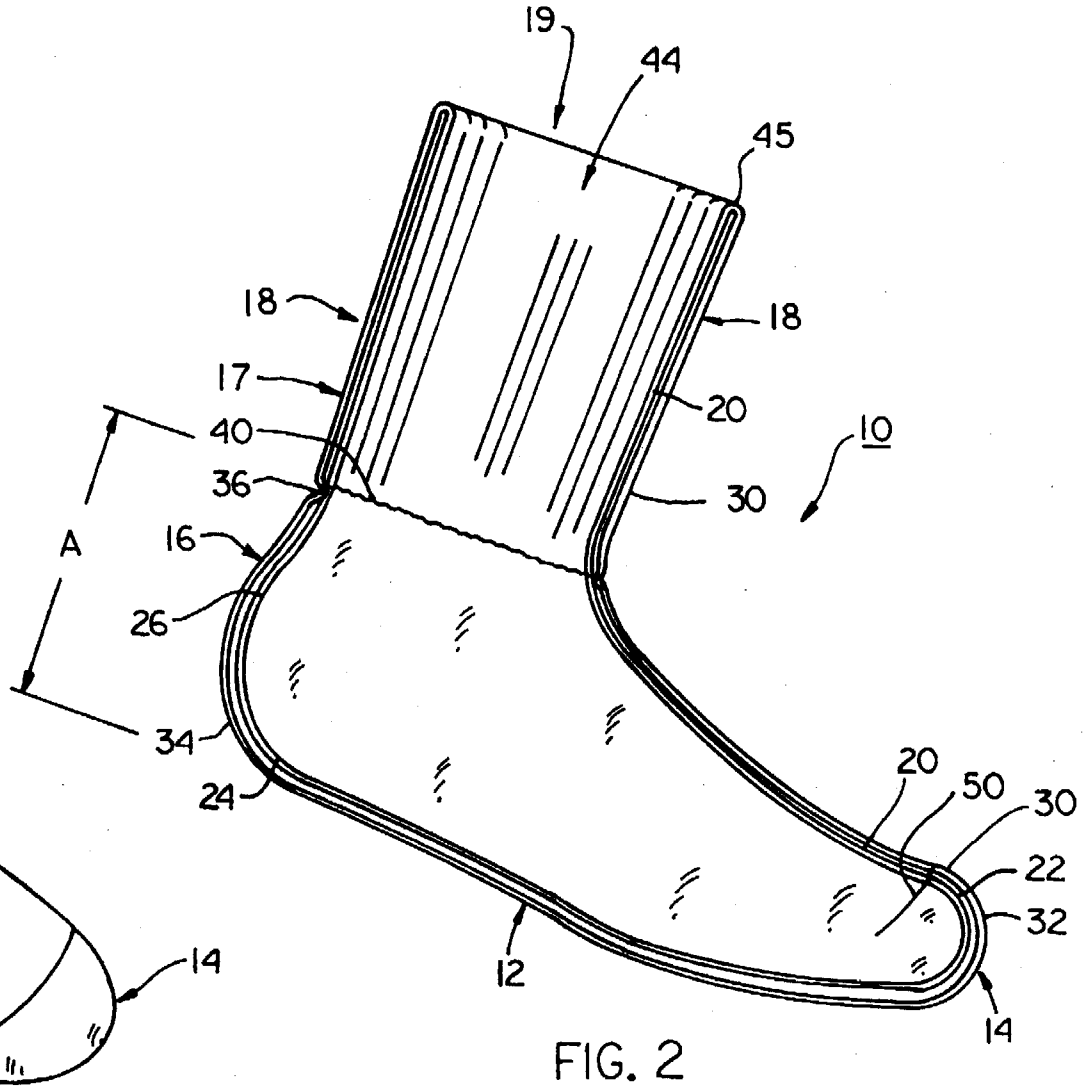
FIG. 2 is a cross-sectional side view taken along line 2—2 of FIG. 1.
Figure 1:
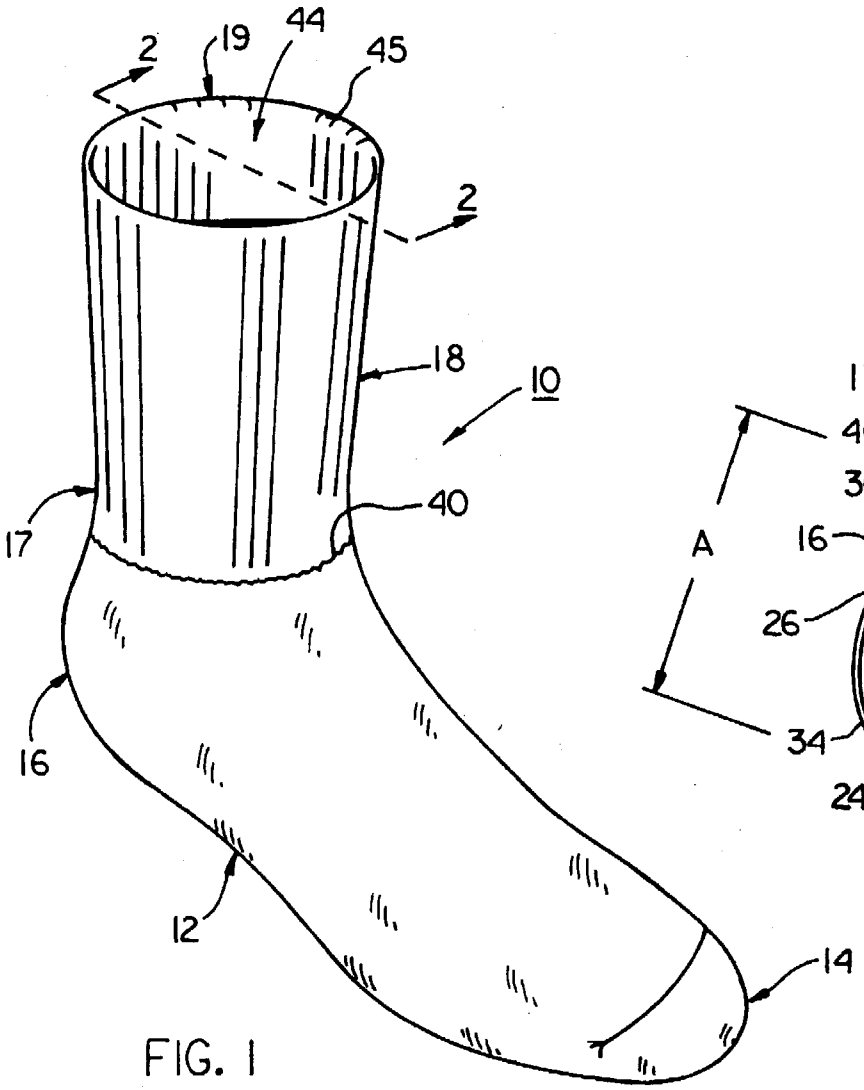
FIG. 1 is a side, perspective view of a sock according to the present invention.

With reference to FIGS. 1 and 2, a sock according to the present invention is shown therein and generally denoted by the numeral 10. Sock 10 is of a double ply construction, and is characterized by the provision of a selectively located seam interconnecting the plies. The interconnecting seam serves to overcome certain drawbacks of conventional double ply socks without sacrificing the benefits of such socks.

Turning to the sock in more detail, sock 10 has foot portion 12 extending from toe end 14 to ankle end 16. Leg portion 18 has lower end 17 which is attached to ankle end 16 of foot portion 12. Leg portion 18 extends to upper end 19 which defines top opening 44. Sock 10 includes inner ply 20 disposed within outer ply 30, each extending through at least a portion of foot portion 12 and through at least a portion of leg portion 18. Seam 40 connects inner ply 20 and outer ply 30. While sock 10 may be of any length, it is preferably sized such that top opening 44 is positioned at or just above the wearer's calf when the sock is worn.

In the preferred embodiment as shown in FIG. 2, inner and outer plies 20, 30 extend the entire length of sock 10 from toe end 14 to top opening 44. Outer ply 30 surrounds inner ply 20 such that toe end 32, heel pocket 34 and ankle end 36 of the outer ply align with the corresponding parts 22, 24, 26 of the inner ply. It is also contemplated that the inner and outer plies may extend through less than the full length of the sock. In such case, the two plies must both extend continuously through at least a portion of the foot and leg portions. That is, the sock must have two plies at seam 40.

Seam 40 attaches inner ply 20 and outer ply 30 to one another between ankle end 16 and top opening 44. Seam 40 is positioned such that the two plies extend both above and below the seam. Preferably, seam 40 extends about the entire circumference of the sock thereby joining the plies in a continuous manner. One of ordinary skill in the art will realize that seam 40 may also extend a distance less than the entire circumference of the sock, though with less beneficial results. Seam 40 is knit to attach the plies which ensures alignment of the plies. More particularly, as described more fully hereinbelow, seam 40 is preferably knit during the knitting of the tube which forms the sock in a manner which ensures proper alignment of the wales of the inner ply with the wales of the outer ply. It will be understood by one of ordinary skill in the art that seam 40 may be comprised of a single stitch row, double stitch, or similar method. Preferably, seam 40 is positioned a distance A from the bottom of heel pocket 34 of from about 1½ to 2½ inches.

The joinder of plies 20, 30 by seam 40 serves to maintain the two plies in alignment. In particular, heel pockets 24, 34 are kept aligned when the sock is being washed or pulled onto the foot, for example. On the other hand, this construction does not restrict movement of inner ply 20 in relation to outer ply 30 in the range typically experienced when the sock is worn, thereby allowing inner ply 20 to move with the wearer's foot to maintain comfort.

In the preferred embodiment as shown, inner and outer plies 20, 30 are formed from a single, continuous knit tube. Top opening 44 is formed by fold 45 in the continuous tube between inner and outer plies 20, 30. Top opening 44 is arranged and configured to receive a wearer's foot. It will also be understood that top opening 44 may also be defined by a single ply band(not shown) attached to leg portion 18 at upper end 19. The single ply band may join the plies 20, 30, or may be sewn to fold 45. In either case, the single ply band extends upwardly from the upper end 19 of leg portion 18.

Figure 4:
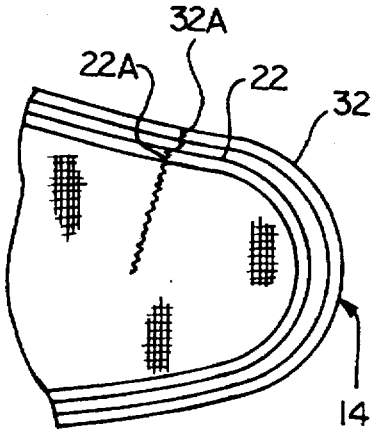
FIG. 4 is a fragmentary, cross-sectional view of a sock according to the present invention incorporating an alternative toe closure construction.

Preferably, inner ply toe end 22 and outer ply toe end 32 are closed by a common seam 50 as seen in FIG. 2. This arrangement keeps both plies aligned throughout the toe end 14 and heel pockets 24, 34. Alternatively, as seen in FIG. 4, inner ply toe end 22 is closed by seam 22A and outer ply toe end 32 is closed by seam 32A.

Figure 3:
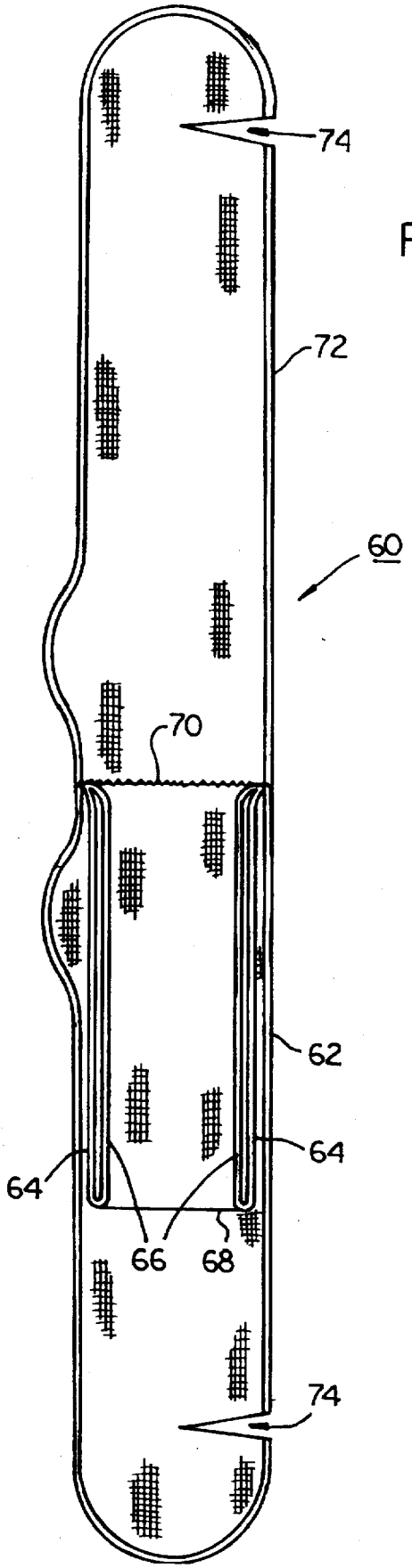
FIG. 3 is a cross-sectional side view of a unitary, continuous knitted tube for forming a sock according to the present invention.

Sock 10 may be formed in the following manner using a conventional circular knitting machine. Suitable machines include any 54 to 240 needle, 1½–6 inches diameter circular hosiery knitting machine with dial tops available from Speizman Industries, P.A.M. Trading Co., and others. With reference to FIG. 3, a sock construction for forming sock 10 is shown therein in cross-section. Inner foot portion 62 is knit by the knitting needles of the machine (not shown) in a conventional manner such that the tubular fabric that is formed extends downwardly through the needle cylinder (not shown). After inner foot portion 62 is knit to the desired length, the dial bits come out and receive the knitting yarn. The yarn is knit on the dial bits for one or more revolutions of the machine. The dial bits, still holding the last knit course, are then pulled in out of the way of the knitting needles and held in. While the inner foot portion 62 is held by the dial bits, the inner leg portion 64 and subsequently outer leg portion 66 are knit by the knitting needles. The continuous tube of the leg portions 64, 66 drops down into inner foot portion 62. When the leg portions, separated by fold line 68, have been knit to the desired length (preferably equal lengths), the dial bits come back out into the paths of the knitting needles, causing the knitting needles to take the yarn of the last course of the inner foot portion and to knit this course into the outer ply which is being formed. That is, the inner foot portion 62 is released back into the path of the knitting needles thereby joining the inner foot portion 62 to the outer ply via a common seam 70 that is knit into both plies and which extends around the circumference of the sock.

After the common seam 70 is knit into the sock, the outer foot portion 72 is knit, the remainder of the construction falling down into the cylinder. After the outer foot portion 72 is knit to the desired length, the sock is removed from the knitting machine as shown in FIG. 3. The open toe ends 74 are then closed forming a foot portion. It will be understood by one of ordinary skill in the art that the order of knitting the foot portions may be reversed such that the outer foot portion 72 may be the knit before inner foot portion 62.

A primary advantage of the method just described is provided by the steps of knitting seam 70 (ultimately seam 40 of the sock). Because the seam is knit during the knitting of the tube, exact alignment of the wales of the inner ply with the wales of the outer ply at the seam is ensured by the knitting machine. In this way, exact alignment of the plies is ensured without requiring expensive and inefficient supplemental procedures.

It is also contemplated that the seam may be sewn into the sock following formation of the tube. However, it will be appreciated that the benefits of knitting the seam as just described will be lost.

An alternative embodiment of the present invention is contemplated wherein inner ply 20 is formed separately of outer ply 30. The sections are attached by sewing or similar methods adjacent the top opening 44 and seam 40.

While preferred embodiments of the present invention have been described, it will be appreciated by those of ordinary skill in the art that certain modifications may be made without departing from the scope of the present invention. All such modifications are intended to come within the scope of the claims which follow.

What is claimed is:

1. A double layer sock comprising:

a) a tubular inner ply having a foot portion and a leg portion merging substantially at the ankle of a wearer;

b) a tubular outer ply surrounding said inner ply, said outer ply having a foot portion and a leg portion merging substantially at the ankle of the wearer and aligning with said foot portion and said leg portion, respectively, of said inner ply;

c) said inner ply and said outer ply defining a top opening in said leg portion arranged and configured to receive a wearer's foot, said inner and outer plies being joined adjacent said top opening; and d) a seam joining said inner ply and said outer ply, said seam located in a location substantially adjacent said merging of said foot portions and leg portions for the purpose of maintaining proper alignment of the foot portions of the two plies, said inner and outer plies each extending above and below said seam.

2. The sock of claim 1, wherein each of said inner and outer plies extend the entire length of said sock.

3. The sock of claim 1, wherein each of said foot portions of said inner and outer plies extends to a respective toe end.

4. The sock of claim 1, including a single ply band attached to each of said leg portions of said inner and outer plies at said upper ends thereof and extending upwardly therefrom.

5. The sock of claim 1, wherein each of said foot portions of said inner and outer plies has a respective toe end opening, said respective toe end openings being closed by a common seam.

6. The sock of claim 1, wherein each of said foot portions of said inner and outer plies has a respective toe end opening closed by a respective end seam.

7. The sock of claim 1, further including a respective heel pocket in each of said inner and outer plies, said heel pockets disposed proximate a wearer's heel when said sock is worn.

8. The sock of claim 7, wherein each of said foot portions of said inner and outer plies has a respective toe end and said heel pockets are disposed between said connecting seam and said respective toe ends.

9. The sock of claim 1, wherein said connecting seam connects said inner ply to said outer ply by a continuous stitch row extending around the circumference of said sock.

10. The sock of claim 1, wherein said inner and outer plies are constructed from a unitary knitting operation, said plies connected by a fold line at said top opening.

11. The sock of claim 1, wherein said seam is knit into each of said inner and outer plies.

12. A method of making a two ply sock of unitary tubular construction, comprising the steps of:

a) knitting a first foot portion;

b) knitting a first leg portion that is attached to the first foot portion and a second leg portion that is attached to the first leg portion;

c) knitting a common seam joining the first foot portion, the first leg portion and the second leg portion;

d) knitting a second foot portion attached to the common seam; and e) closing the first and second foot portions.

13. The method of claim 12, wherein the step of knitting the seam includes knitting the seam such that it extends about the circumference of the sock.

14. A method of making a two ply sock having an inner ply and an outer ply, comprising the steps of:

a) knitting a singular tubular garment having a first continuous section corresponding to the inner ply and a second continuous section corresponding to the outer ply, the garment having opposed open ends;

b) forming a fold between the first and second sections;

c) closing the open ends of the garment; and d) joining the first and second sections together by a connecting seam at a location in the garment above a wearer's ankle when the sock is worn.

15. The method of claim 14, wherein the step of joining the first and second sections includes inserting the connecting seam such that it extends about the circumference of the sock.

16. The method of claim 14, wherein the step of joining the first and second sections includes knitting the connecting seam into each of the first and second sections.

17. The method of claim 14, wherein the step of joining the first and second sections includes sewing the connecting seam into each of the first and second sections.

* * * * *